United States Patent [19]

Pearson

[11] 4,123,865

[45] Nov. 7, 1978

[54] SHOW WINDOW ANIMATION

[76] Inventor: Lonnie B. Pearson, 501 Sandia, Clovis, N. Mex. 88101

[21] Appl. No.: 761,622

[22] Filed: Jan. 24, 1977

[51] Int. Cl.[2] ..... G09F 11/00

[52] U.S. Cl. ..... 40/414; 46/126; 223/120; 272/21

[58] Field of Search ..... 40/106.3, 106.34, 106.35, 40/106.36, 138, 139, 36, 41, 78, 78.03, 78.07, 411, 415–420, 613, 614; 223/120; 46/264, 265, 126, 13; 211/87, 89; 272/11, 21, 22

[56] References Cited

U.S. PATENT DOCUMENTS

| | | | |
|---|---|---|---|
| 1,810,890 | 6/1931 | Allen | 272/22 UX |
| 2,932,919 | 4/1960 | Evans | 40/139 X |

*Primary Examiner*—John F. Pitrelli
*Assistant Examiner*—G. Lee Skillington
*Attorney, Agent, or Firm*—Wendell Coffee

[57] ABSTRACT

A device to animate clothing and other merchandise for sale in a store window includes a crankshaft with a plurality of cranks. One of the cranks is connected by a pitman to a pivoted rocker arm. Strings extend from the rocking arm or the cranks either directly to portions of articles of clothing or by pulleys to articles of clothing which may be placed remote from the animation device.

10 Claims, 3 Drawing Figures

87
84
72
82
68
60
74
18
88
24
26
56
62
80
30
40
61
42
64
63
54
36
38
44
46
3
48
76
70
78
16
20
10
86
79

SHOW WINDOW ANIMATION

CROSS-REFERENCE TO RELATED APPLICATIONS

None. However, applicant filed Disclosure Document No. 044215 on Oct. 14, 1975, which document concerns this application; therefore, by separate paper, it is respectfully requested that the document be retained.

BACKGROUND OF THE INVENTION (1) Field of the Invention

This invention relates to display or exhibiting devices which move three dimensional objects.

(2) Description of the Prior Art

Before my invention, animation devices were widely used to move marionettes or puppets for entertainment purposes. For example, EVANS, U.S. Pat. No. 2,932,919, disclosed an electrically operated device with a simple crank which would animate a plurality of puppets to march like soldiers. CONLEY, U.S. Pat. No. 2,093,710, disclosed use of a double-throw crank which would drive a small puppet simulating a woman at a rub board or performing other household tasks, such as sweeping a floor. UELTISCHI, U.S. Pat. No. 2,615,282, discloses levers which are operated by cylindrical cam surfaces. The cams deviate from their surfaces both radially and axially so that complex movements of the marionettes are obtained.

OPPENHEIM, U.S. Pat. No. 3,024,551, discloses a complex marionette operation. Cylindrical cam surfaces such as UELTISCHI are used, and the marionettes are controlled by strings which are trained through pulleys and connected to levers.

Applicant is also aware of OZSAK ET AL, U.S. Pat. No. 3,770,274, and KLEMA, U.S. Pat. No. 2,012,468, at the time of filing this patent application.

SUMMARY OF THE INVENTION (1) New and Different Function

I have invented an animation device particularly adapted for use in a store window or other display area to sell merchandise, particularly clothing. It is well known that movement or animation is more attention-getting and attracting than a static display. It is not necessary to simulate human movement to sell the merchandise, but movement is desirable. Some of the movement can show different sides or parts of the same article which would otherwise be hidden from view or display.

I choose to achieve this movement by a crankshaft with a plurality of cranks. The articles may be connected by strings directly to the crank, so that there is somewhat more complex movement than when they are connected through pulleys. However, I also prefer to connect some of the articles to the cranks through pulleys so that they can be placed at a remote point from the single drive source. It is important that the physical size of the drive source be maintained compact so that it is readily transported by the U.S. Mails or other parcel delivery services.

A simple rocker arm is used to obtain either greater or lesser movement than is achieved by direct connections to the cranks.

Thus, it may be seen that in combination, I achieve results and functions which are far greater than the sum of the functions of the individual parts, such as pulleys, strings, or cranks.

(2) Objects of this Invention

An object of this invention is to display merchandise for sale.

Further objects are to achieve the above with a device that is sturdy compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 1:
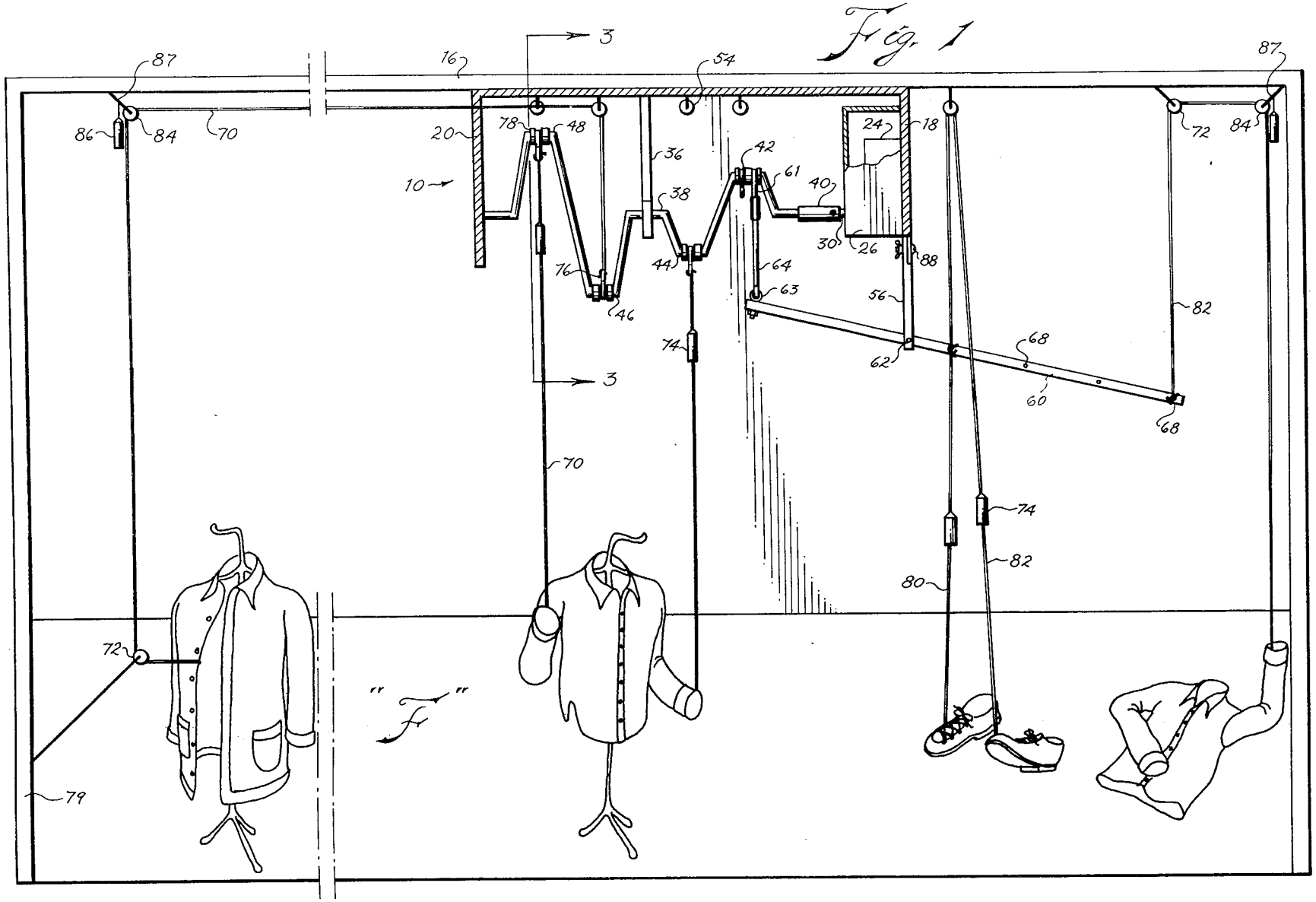
FIG. 1 is a front elevational view of a store window with an embodiment of this invention therein. The store window is broken to indicate that some articles of merchandise are distantly removed from the power unit. The front curtain of the unit and motor housing are broken away, totally or partially, for clarity.
Figure 2:
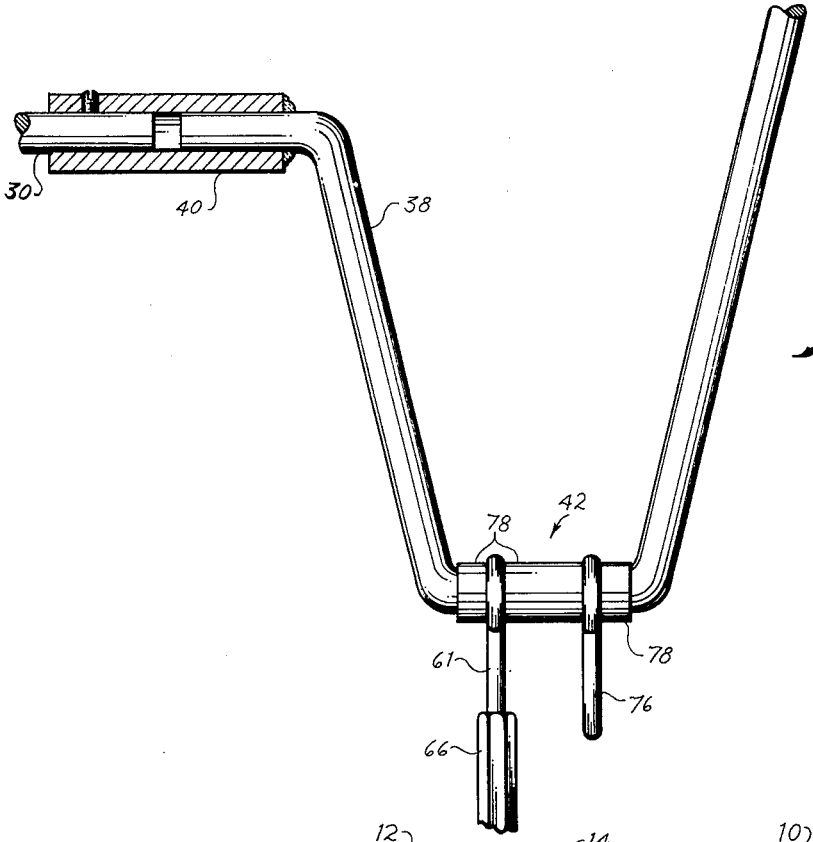
FIG. 2 is a detail of the crankshaft connection and of one crank.
Figure 3:
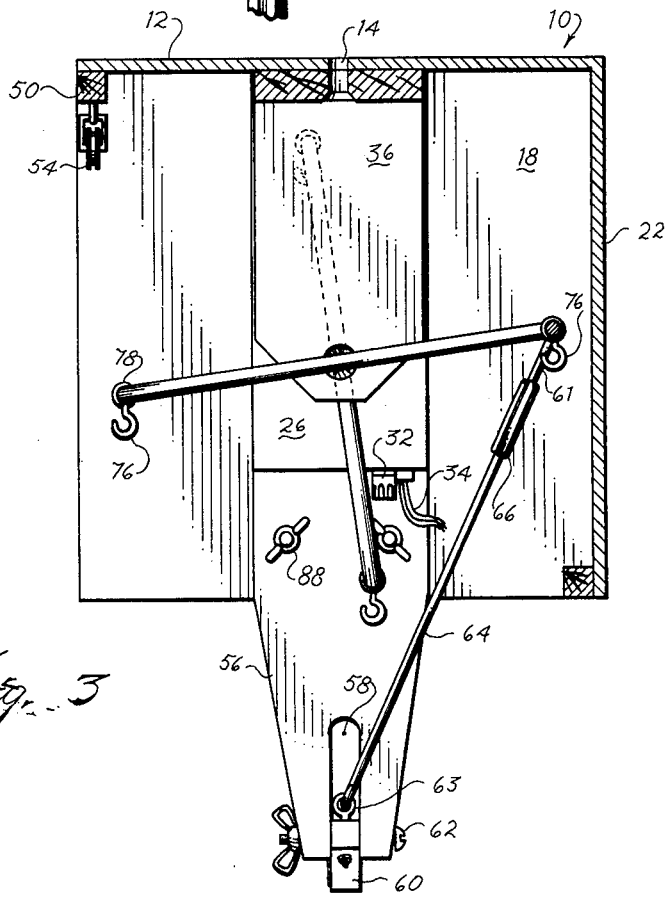
FIG. 3 is a side sectional view taken substantially on line 3—3 of FIG. 1 of the device, not showing the store window structure.

Referring to the drawings, it will be noted that the mechanism is basically contained within housing 10.

The housing includes top 12. The top has holes 14 therethrough. These holes form attachment means for attaching the housing to overhead support 16. It is contemplated that normally this overhead support would be the ceiling of a show window such as the store window of a department store.

The housing 10 also has two sides, one of which is designated as motor side 18, and the other as distal side 20. Front curtain or barrier 22, preferably made of plywood, extends from the motor side of the distal side from the top 12.

As previously stated, it is desirable if the entire device can be packaged for shipment by standard parcel carrying services or postal services. I prefer to completely assemble the housing before shipment so that all connections between the top, sides, and front curtain are made permanent by riveting or welding. Therefore, it is desirable that this housing itself be within the limits that are accepted by the postal and package carrying services; therefore, the sides 18 and 20 have a dimension of 30cm × 30cm, and the length, which is the length of the curtain 22 and which is the distance from one side to the other, is 76cm.

Electric motor 24 is mounted within motor housing 26 attached to the motor side 18. In this manner, the electric motor 24 is attached to the housing 10. The motor has an attached gear box so that motor shaft 30 extends from the housing to rotate at a low speed. The motor is provided with fuse 32 and electrical cord 34. There is no switch provided except for unplugging the electrical cord. Bearing support 36 depends from the top 12 at about the midpoint of the top. Crankshaft 38 extends from a bearing on the distal side 20 to the bearing support 36 and terminates coaxially with the motor shaft 30 adjacent thereto. Coupling 40 connects the motor shaft to the crankshaft.

I prefer to use a four-throw crankshaft, which is to say there are four cranks spaced at 90°. Between the motor housing 26 and the bearing support 36 there are two motor cranks 42 and 44 which are displaced 180°. Between the bearing support 36 and the distal side 20 are two distal cranks 46 and 48 which are displaced from each other by 180° and displaced from the other by 90°, all as seen in FIG. 1.

Wooden rib 50 is attached along the back edge of the top 12. A connector is attached to the rib for each of the cranks 42, 44, 46, and 48. A pulley 54 is attached to each connector.

Projection arm 56 is attached to the motor side 18 and depends therefrom. The projection arm 56 is bifurcated at its lower extremity 58. Rocker arm or lever 60 is pivoted to the bifurcation 58 by pivot bolt 62. In a horizontal position the rocker arm 60 is parallel to the crankshaft 38. Eyebolt 61 is connected to the motor crank 42 which is adjacent to the motor housing 26. Another eyebolt is attached into the end of the rocker arm 60 which is in approximate alignment with the motor crank 42. Pitman 64 has a loop which loops into the eyebolt 63 in the end of the rocker arm 60. The pitman 64 and the eyebolt 61 on the crank have right and left threads and are connected by turnbuckle 66.

A plurality of rocker connections 68 for attachment of strings are serially attached along the rocker arm 60 distally of the pivot bolt 62.

Strings 70 extend from the various cranks 42, 44, 46, and 48, to merchandise displayed for sale. I prefer to use monofilament synthetic material, such as nylon fishing line, for the string 70 since it is very strong and almost invisible. As seen in the drawing, the string 70 can be connected directly from the cranks to the article of clothing or it can be connected from the cranks around pulleys 54 to the article of clothing. Also, the strings may be connected from cranks through the pulleys 54 and through one or more remote pulleys 72 to articles of clothing.

It is not necessary that the article of merchandise be suspended at all times; however, it is necessary that the strings 70 be maintained free of slack. I.e., the strings must always be under tension. It is possible to maintain tension on the strings by attaching small weights 74, similar to fishing weights, to the strings so that they always maintain tension upon them. Normally an article is supported by a supporting surface, such as floor "F," but during a short time when the crank was near dead center, the article would raise and remain suspended for a short period of time and then set back down. Of course, the crank may be at dead center when it is upward if the string extends directly straight down, but if the string is suspended through the pulley 54, it would be when the crank was most remote from the pulley.

Strings 70 are attached to the cranks 42–48 by S-hooks 76. One end of the S-hook is looped around the crank and the string 70 is tied to the other end. The position of the S-hooks upon the crank is maintained by short tubes of synthetic material which are over the cranks. These spacers 78 must be not placed too closely to the S-hooks inasmuch as the S-hooks must rotate as the cranks rotate.

Additonal strings 80 and 82 extend from one or more of the rocker connections 68 upon rocker arm 60. The string 80 is shown depending directly to articles of merchandise. The string 82 extends through a remote pulley. It will be noted that if the two strings 80 and 82 are attached to the same rocker connection 68 and one depends directly downward and the other extends to a remote pulley immediately over the rocker arm 68 and then down, the two strings will have equal and opposite movement. Also, if the strings are attached to the rocker connection 68 close to the pivot bolt 62, they will have very small movement, but if they are attached to the extremities of the rocker arm 60, they will have a larger movement. Of course the string 82 is not limited to being trained through the single remote pulley 72, but may be trained through two or three remote pulleys so that they may animate articles of merchandise considerably removed from the housing 10.

To display remote items of clothing, i.e., a considerable distance from the housing, additional pulleys 84 are used. These additional pulleys 84 may be attached to the overhead support 16 or the wall 79 of the show window. The pulleys 84 are connected by flexible leads 87 to either the overhead stationary support or the wall. stationary support. The flexible lead may be of monofilament nylon, the same material as is used for the strings. As explained above, it is necessary that there never be slack in the strings. Therefore, often when a pulley is connected by one of the flexible leads 87, I hang an additional weight 86 from the lead 97 adjacent to the pulley 84. The weight 86 will cause the pulley to hang downward against the tension of the string.

As stated above, it is desirable that the housing 10 be able to be packaged for mailing. Therefore, the bifurcated projection arm 56 is attached to the motor side by a pair of bolts 88 which extend through the motor side 18 and holes in the projection arm and tightened in place by convenient thumb nuts. It is necessary, therefore, that the projection arm be of a lesser dimension than the length of the device. Likewise, the rocker arm 60 has a length of approximately the diagonal of the housing so that when it is removed from its connection, it is conveniently placed within the housing and does not increase the size for shipping.

Thus it may be seen that I have provided a single unit for animating a plurality of articles of merchandise at remote locations which is also suitable for packaging and delivery. A variety of movements may be obtained, such as constant reciprocation, or movement where the display item is normally at rest, but then has movement away from rest and back to rest.

As an aid to correlating the terms of the claims to the exemplary drawing, the following catalog of elements is provided:

| | | | |
|---|---|---|---|
| 10 | housing | 58 | bifurcation |
| 12 | top | 60 | rocker arm |
| 14 | holes | 61 | eyebolt |
| 16 | overhead support | 62 | pivot bolt |
| 18 | motor side | 63 | eyebolt |
| 20 | distal side | 64 | pitman |
| 22 | front curtain | 66 | turnbuckle |
| 24 | motor | 68 | rocker connections |
| 26 | motor housing | 70 | strings |
| 30 | motor shaft | 72 | remote pulleys |
| 32 | fuse | 74 | weights |
| 34 | electrical cord | 76 | S-hooks |
| 36 | bearing support | 78 | spacers |
| 38 | crankshaft | 79 | wall |

-continued

| | | | |
|---|---|---|---|
| 40 | coupling | 80 | additional string |
| 42 | motor crank | 82 | additional string |
| 44 | motor crank | 84 | additional pulleys |
| 46 | distal crank | 86 | additional weights |
| 48 | distal crank | 87 | leads |
| 50 | wooden rib | 88 | bolts |
| 54 | pulley | F | floor |
| 56 | projection arm | | |

The embodiment shown and described above is only exemplary. I do not claim to have inverted all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A store display animation device for displaying merchandise for sale comprising:

a. a partial housing including
(i) a top,
(ii) a motor side,
(iii) a distal side, and
(iv) a front curtain, b. attachment means on the top for attaching the housing to an overhead support, c. a motor attached to the motor side, d. a crankshaft extending from the motor to the distal side, e. a plurality of cranks on the crank shaft, f. strings extending from the cranks to the merchandise to be sold, and g. weights on the string between the cranks and the merchandise to be sold.

2. The invention as defined in claim 1 with additional limitations of g. an S-hook on each crank, h. said string attached to the S-hook, and j. tubular spacers around the crank on each side of the S-hook.

3. The invention as defined in claim 2 with additional limitations of k. a back pulley secured to the back edge of the top, m. at least one of said strings extending from said crank to said pulley and thus to said article of merchandise, n. said weight being on the string between said pulley and the merchandise to be sold.

4. The invention as defined in claim 1 with additional limitations of g. a back pulley secured to the back edge of the top, h. at least one of said strings extending from said crank around said pulley, and thus to said article of merchandise.

5. The invention as defined in claim 4 with additional limitations of j. a second pulley for at least one of said strings which extends through the back pulley, k. said second pulley remote from said housing and located on its string between the back pulley and the merchandise.

6. A store display animation device for displaying merchandise for sale comprising:

a. a partial housing including
(i) a top,
(ii) a motor side,
(iii) a distal side, and
(iv) a front curtain, b. attachment means on the top for attaching the housing to an overhead support, c. a motor attached to the motor side, d. a crankshaft extending from the motor to the distal side, e. a plurality of cranks on the crank shaft, f. strings extending from the cranks to the merchandise to be sold, g. a bifurcated projection arm attached to the housing, h. a pivot bolt in the bifurcation of said projection arm, j. a rocker arm journaled in said bifurcation on said pivot bolt, k. a pitman from one of said cranks to said rocker arm, m. a plurality of rocker connections to said rocker arm for attachment of strings, and n. a string attached to at least one of said connections and extending to an article of merchandise.

7. The invention as defined in claim 6 with additional limitations of o. a back pulley secured to the back edge of the top, p. at least one of said strings extending from said crank around said pulley, and thus to said article of merchandise.

8. The invention as defined in claim 7 with additional limitations of q. a second pulley for at least one of said strings which extends through the back pulley, r. said second pulley remote from said housing and located at its string between the back pulley and the merchandise.

9. The invention as defined in claim 8 with additional limitations of s. an S-hook on each crank, t. said string attached to the S-hook.

10. The invention as defined in claim 9 with an additional limitation of u. tubular spacers around the crank on each side of the S-hook.

* * * * *